US009689138B2

(12) United States Patent
Seda et al.

(10) Patent No.: US 9,689,138 B2
(45) Date of Patent: Jun. 27, 2017

(54) LOADER COUPLER WITH REMOVABLE MOUNT PINS

(75) Inventors: Anthony G. Seda, Ravenna, OH (US); Adam L. Bricker, North Canton, OH (US); Michael T. Boles, Canal Fulton, OH (US); Shadruz Daraie, Fairlawn, OH (US)

(73) Assignee: Paladin Brands Group, Inc., Oak Brooks, IL (US)

( * ) Notice: Subject to any disclaimer, the term of this patent is extended or adjusted under 35 U.S.C. 154(b) by 0 days.

(21) Appl. No.: 13/423,242

(22) Filed: Mar. 18, 2012

(65) Prior Publication Data

US 2012/0237292 A1 Sep. 20, 2012

Related U.S. Application Data

(60) Provisional application No. 61/454,249, filed on Mar. 18, 2011.

(51) Int. Cl.
*F16B 21/00* (2006.01)
*E02F 3/36* (2006.01)

(52) U.S. Cl.
CPC ..... *E02F 3/3631* (2013.01); *E02F 3/365* (2013.01); *E02F 3/3636* (2013.01); *Y10T 403/59* (2015.01); *Y10T 403/593* (2015.01); *Y10T 403/7075* (2015.01)

(58) Field of Classification Search
CPC ..... E02F 3/3631; E02F 3/3636; E02F 3/365
USPC ..... 403/321, 322.1, 322.3, 162, 163, 161; 37/468, 235, 231; 172/273, 810, 811, 172/272, 439
See application file for complete search history.

(56) References Cited

U.S. PATENT DOCUMENTS 3,841,771 A * 10/1974 Shankwitz et al. ..... 403/163
4,022,536 A * 5/1977 Piepho et al. ..... 403/16
4,056,250 A * 11/1977 Uchiyama ..... 248/674
4,057,112 A * 11/1977 Taylor ..... 172/166
4,100,688 A * 7/1978 Grist ..... 37/403
4,836,741 A * 6/1989 St. Louis et al. ..... 414/723
4,850,789 A * 7/1989 Zimmerman ..... 414/703
(Continued)

OTHER PUBLICATIONS

International Search Report mailed Jun. 22, 2012 for International Application No. PCT/US12/29590.
(Continued)

*Primary Examiner* — Josh Skroupa
*Assistant Examiner* — Matthew R McMahon
(74) *Attorney, Agent, or Firm* — Fay Sharpe LLP

(57) ABSTRACT

A loader coupler includes left and right spaced-apart inner rib mounts including inner mount pins connected to a body, and left and right inner locking regions aligned with the left and right inner rib mounts. The coupler includes left and right spaced-apart outer rib mounts including outer mount pins connected to the body, and left and right outer locking regions aligned with the left and right outer rib mounts. The coupler includes a lock system including: (i) left and right first lock plungers that move between locked and unlocked positions relative to the left and right inner locking regions, respectively; and, (ii) left and right second lock plungers that move between locked and unlocked positions relative to the left and right outer locking regions, respectively. The left and right outer mount pins and/or the left and right inner mount pins are removable from the body.

4 Claims, 17 Drawing Sheets

(56) References Cited

U.S. PATENT DOCUMENTS

| | | | | |
|---|---|---|---|---|
| 4,890,974 | A * | 1/1990 | Kistner | 414/723 |
| 4,963,071 | A * | 10/1990 | Larwin et al. | 414/723 |
| 5,252,022 | A * | 10/1993 | Culp et al. | 414/723 |
| 5,692,850 | A * | 12/1997 | Kimble et al. | 403/24 |
| 5,820,332 | A * | 10/1998 | Philips et al. | 414/723 |
| 5,865,594 | A * | 2/1999 | Kim | 414/723 |
| 5,951,192 | A * | 9/1999 | Collins | 403/150 |
| 6,012,240 | A * | 1/2000 | Klug et al. | 37/231 |
| 6,431,785 | B1 | 8/2002 | Melander | |
| 6,860,039 | B2 * | 3/2005 | Schultz et al. | 37/231 |
| 6,877,259 | B2 * | 4/2005 | Nishimura et al. | 37/468 |
| 7,168,908 | B2 * | 1/2007 | Diaz et al. | 414/723 |
| 7,182,546 | B1 * | 2/2007 | Kimble | 403/322.3 |
| 7,275,909 | B2 * | 10/2007 | Vigholm et al. | 414/723 |
| 7,309,186 | B2 * | 12/2007 | Oertley | 403/288 |
| 7,351,028 | B2 * | 4/2008 | Potter et al. | 414/723 |
| 7,676,964 | B2 * | 3/2010 | Schmeichel | 37/268 |
| 7,824,145 | B2 * | 11/2010 | Kisse | 414/723 |
| 7,836,616 | B2 | 11/2010 | Esser et al. | |
| 7,866,935 | B1 | 1/2011 | Wilt et al. | |
| 7,877,906 | B2 * | 2/2011 | Ramun | 37/403 |
| D643,051 | S | 8/2011 | Bercsik | |
| 8,007,197 | B2 * | 8/2011 | Nye et al. | 403/322.3 |
| D645,063 | S | 9/2011 | Bercsik | |
| 8,549,775 | B2 * | 10/2013 | Lanting et al. | 37/468 |
| 8,596,666 | B1 * | 12/2013 | Hansen et al. | 280/515 |
| 8,833,480 | B2 * | 9/2014 | Grimes et al. | 172/272 |
| 2003/0103804 | A1 * | 6/2003 | Bjuhr | 403/321 |
| 2007/0175071 | A1 | 8/2007 | Priest et al. | |
| 2008/0141566 | A1 | 6/2008 | Esser et al. | |
| 2009/0110530 | A1 * | 4/2009 | Harshberger et al. | 414/686 |
| 2009/0304486 | A1 | 12/2009 | Bricker et al. | |
| 2010/0104359 | A1 | 4/2010 | Seda et al. | |

OTHER PUBLICATIONS

Written Opinion mailed Jun. 22, 2012 for International Application No. PCT/US12/29590.

* cited by examiner

LOADER COUPLER WITH REMOVABLE MOUNT PINS

CROSS-REFERENCE TO RELATED APPLICATION

This application claims priority from and benefit of the filing date of U.S. provisional application Ser. No. 61/454,249 filed Mar. 18, 2011, and the entire disclosure of said prior provisional application is hereby expressly incorporated by reference into the present specification.

BACKGROUND

Loader machines such as front-end loaders and tractor-loaders (each of which is sometimes referred to herein generally as a "loader") often include a quick coupler operatively connected to the arms and control linkage thereof. The coupler is adapted to mate selectively and releasably with an attachment for performing work, such as a construction attachment or agricultural attachment (e.g., a bucket, a boom, a fork attachment, a rake, or the like). The coupler allows an operator of the loader to engage with and disengage from various attachments as needed without exiting the operator's cab. Such couplers provide for improved machine productivity and operator convenience as compared conventional loaders that require each attachment to be connected to and disconnected from the loader arms and control linkage using sliding pins in a so-called "pin-on" connection.

Each attachment must include a receiver structure that is adapted to be engaged by and mated with the coupler. In a basic form, the receiver must have a single, particular configuration to mate with the coupler. More recently, "hybrid" or "multi pick-up" couplers have been developed that are adapted to mate with two different receiver configurations. These multi pick-up couplers are desirable due to their ability to mate with attachments that have either a first or second receiver structure.

A need has been identified for a multi pick-up coupler with an improved structure that reduces weight and simplifies manufacture and provides other benefits and advantages over known designs.

SUMMARY

In accordance with a first aspect of the present development, a loader coupler comprises a body comprising left and right portions. The body further includes left and right laterally spaced-apart inner rib mounts comprising respective inner mount pins connected to the body, and left and right inner locking regions aligned with the left and right inner rib mounts, respectively. The body also includes left and right laterally spaced-apart outer rib mounts comprising respective outer mount pins connected to the body, and left and right outer locking regions aligned with the left and right outer rib mounts, respectively. The coupler includes a lock system connected to the body, the lock system comprising: (i) left and right first lock plungers that move between locked and unlocked positions relative to the left and right inner locking regions, respectively; and, (ii) left and right second lock plungers that move between locked and unlocked positions relative to the left and right outer locking regions, respectively. The left and right outer mount pins and/or the left and right inner mount pins are removably connected to the body.

In accordance with another aspect of the present development, a loader coupler includes a body comprising left and right portions. The coupler includes left and right laterally spaced-apart inner rib mounts, and left and right inner locking regions aligned with the left and right inner rib mounts, respectively. The coupler also includes left and right laterally spaced-apart outer rib mounts, and left and right outer locking regions aligned with the left and right outer rib mounts, respectively. A lock system is adapted to selectively engage an associated attachment rib structure mated with the body. At least one of the inner rib mounts and the outer rib mounts comprise mount pins that are selectively removable from the body.

DETAILED DESCRIPTION

Figure 1:
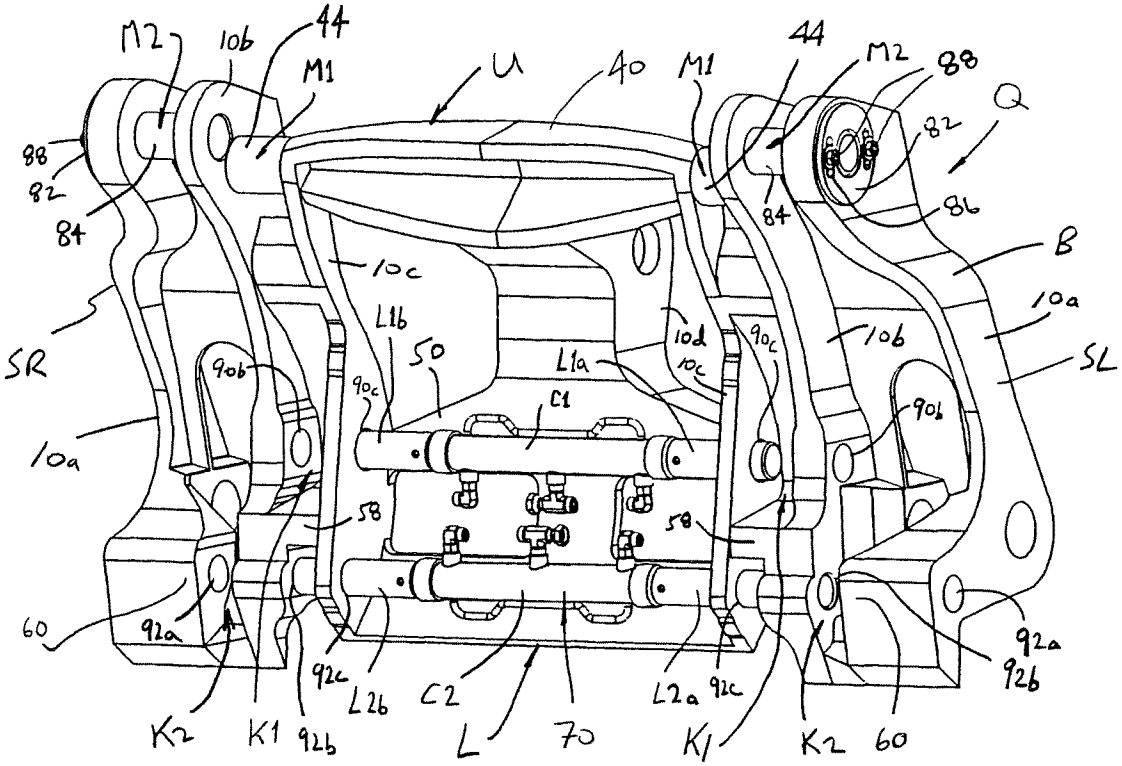
FIGS. 1 and 2 are respective front and rear isometric views of an attachment quick coupler formed in accordance with the present development, with the coupler in its unlocked configuration or condition.
Figure 2:
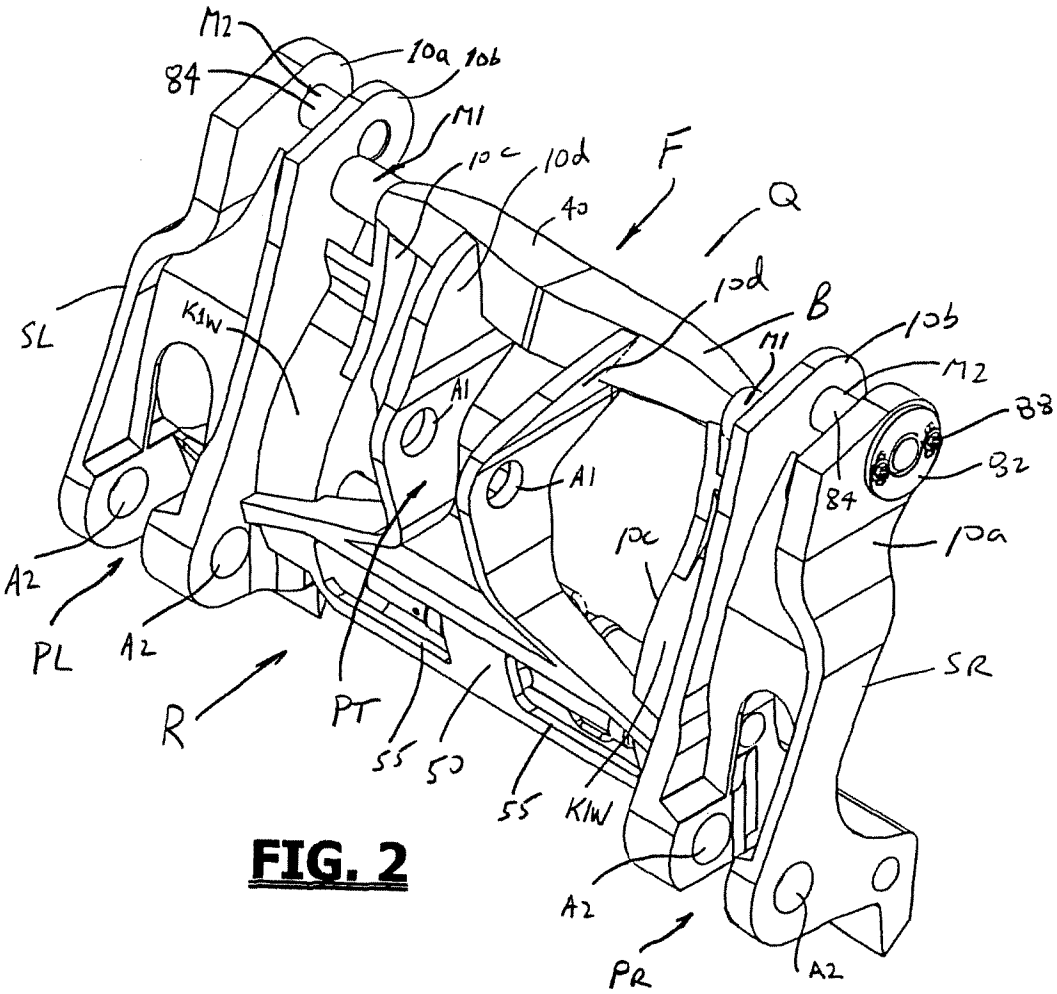
Figure 3:
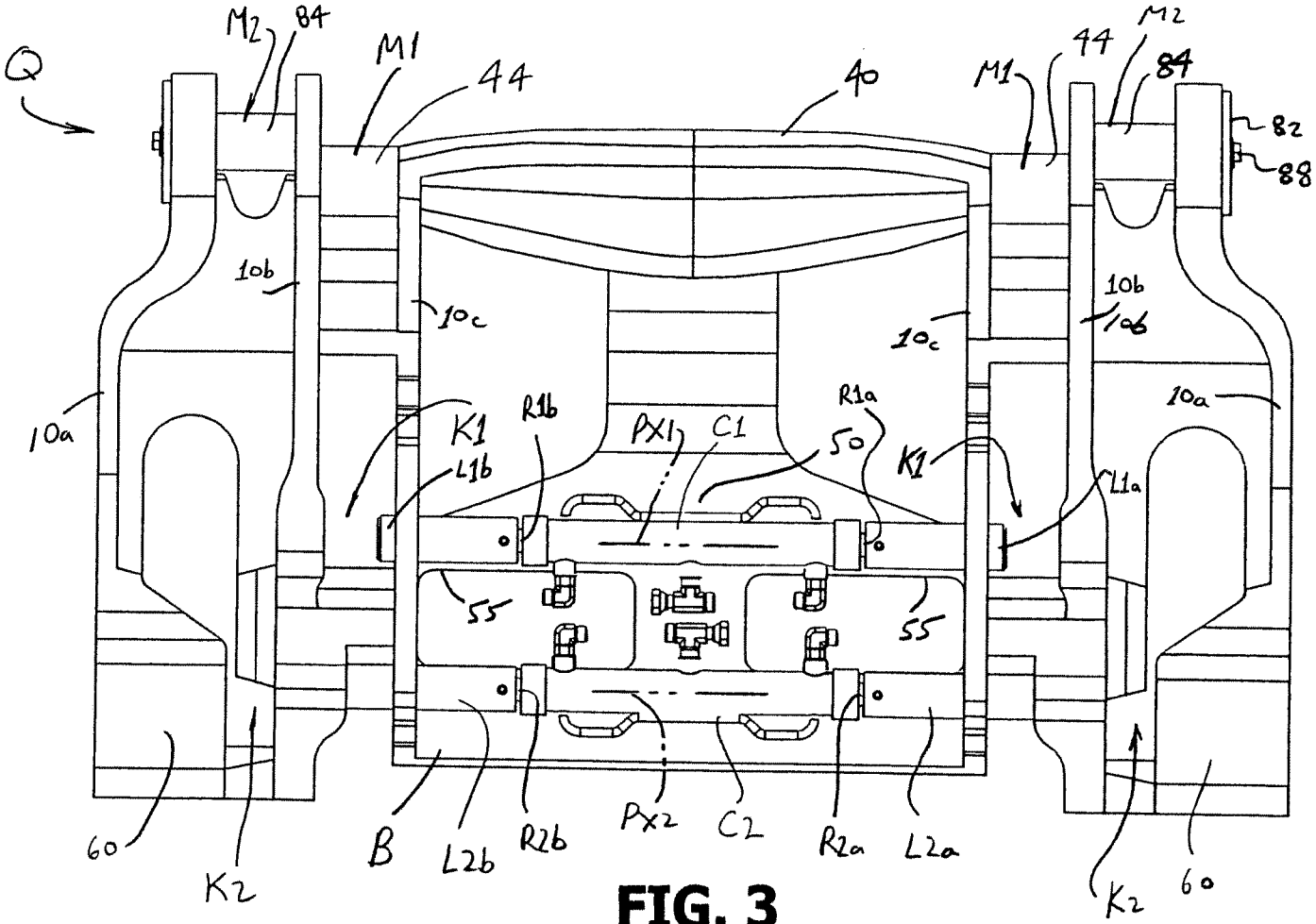
FIGS. 3 and 4 are respective front and rear views of the coupler of FIGS. 1 and 2, with the coupler in its unlocked configuration or condition.
Figure 4:
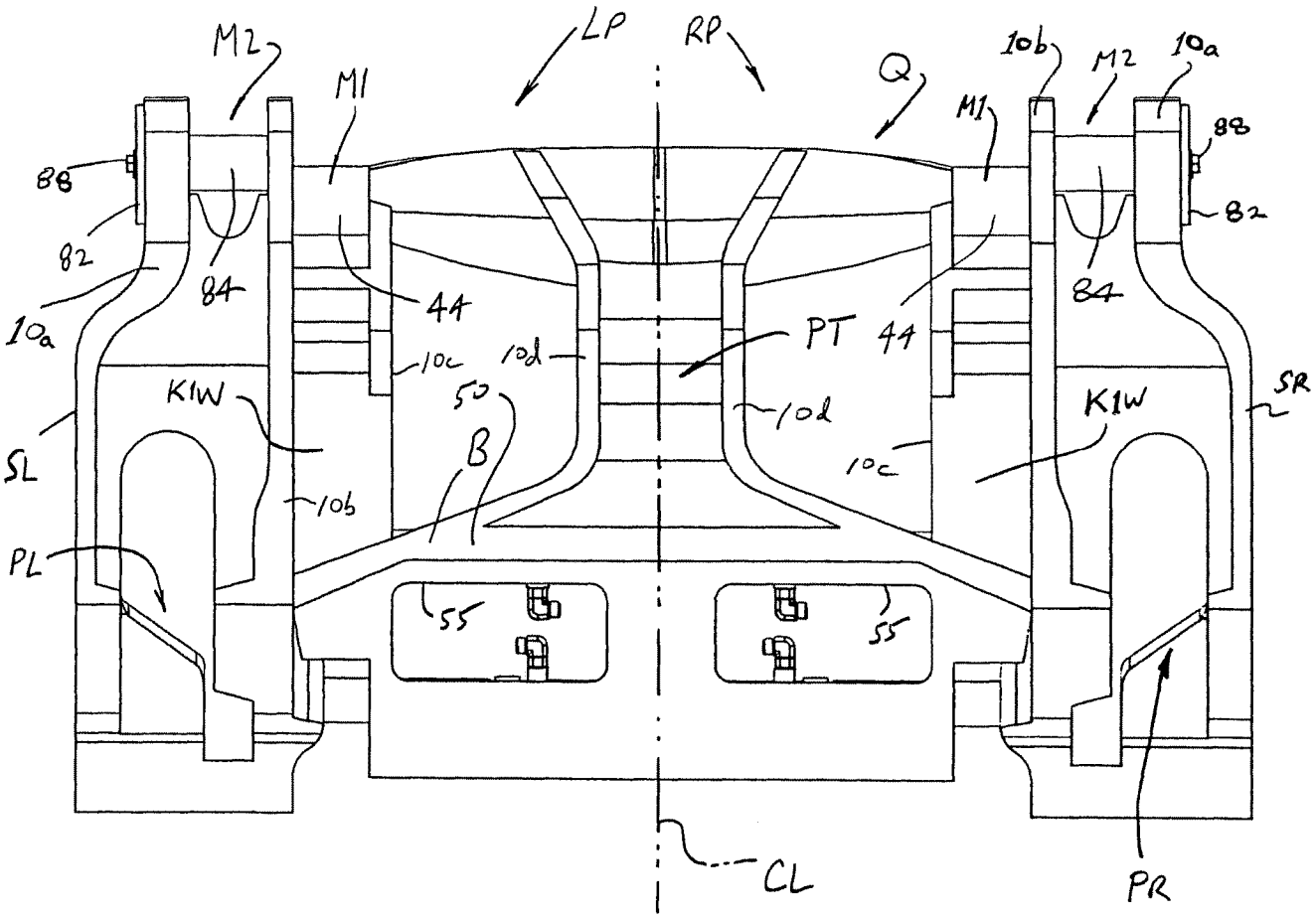
Figure 5:
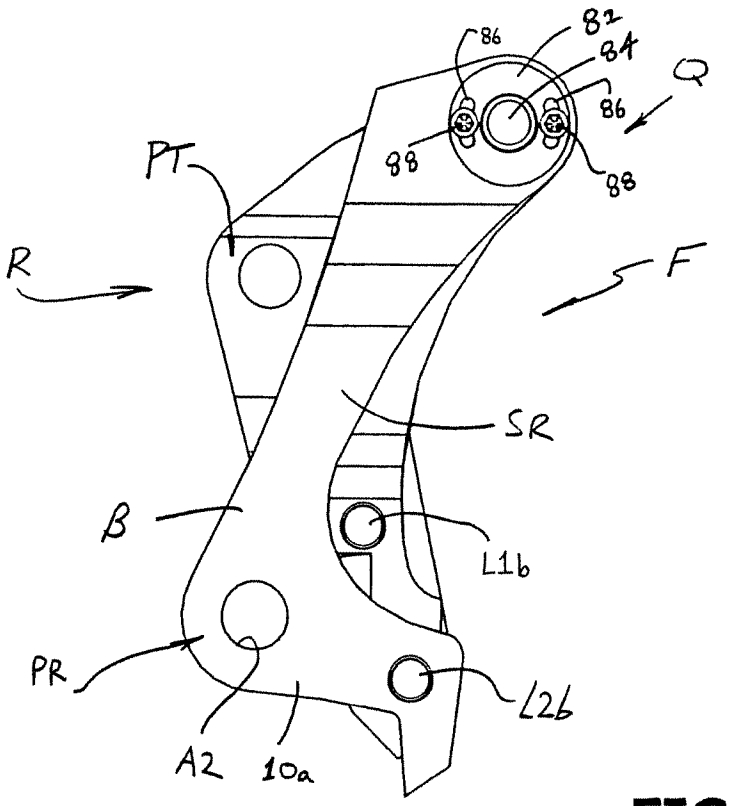
FIGS. 5 and 6 are respective right and left side views of the coupler of FIGS. 1 and 2.
Figure 6:
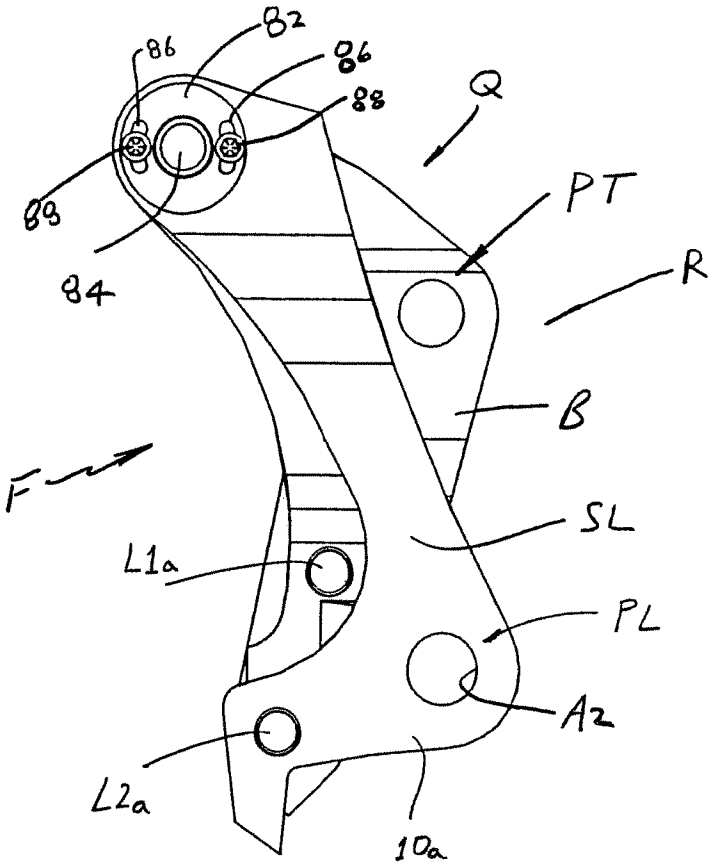

FIGS. 1 and 2 are respective front and rear isometric views of an attachment quick coupler Q formed in accordance with the present development. The coupler Q comprises a frame or body B that has a rear (machine) side R and a front (attachment) side F, left and right lateral sides SL,SR, and upper and lower regions U,L. FIGS. 3 and 4 provide front and rear views of the coupler Q, and FIGS. 5 and 6 provide right and left side views of the coupler Q.

In the illustrated embodiment, as shown particularly in FIG. 4, the basic structure of the body B is symmetrically constructed about a vertical center line CL, so as to include symmetrical left and right portions LP,RP defined between the centerline CL and the left and right lateral sides SL,SR, respectively.

In the illustrated embodiment of FIGS. 1-6, the body B is constructed in one-piece from a casting of steel alloy or other cast metal. The one-piece cast body B comprises multiple laterally spaced-apart primary ribs that extend generally vertically. In the illustrated embodiment, the left and right coupler portions LP,RP each comprise first, second, third, and fourth primary spaced-apart ribs 10*a*,10*b*, 10*c*,10*d*. At least parts of the ribs 10*a*-10*d* are preferably all arranged in parallel, spaced-apart relation to each other.

The two innermost (fourth) ribs 10*d* define a tilt actuator pin-on location PT by which and where the associated loader tilt-link or cylinder rod eye or other tilt actuator of the loader control linkage is operatively and pivotally secured to the coupler body B. The ribs 10*d* define a channel between themselves, and the ribs 10*d* include respective apertures A1 that are aligned with each other. An associated control linkage tilt actuator such as a tilt-link, rod-eye or the like of a loader or other associated machine to which the coupler body B is connected is inserted in the channel between the ribs 10*d* and pinned in position by a pin inserted into the aligned apertures A1 and through a bore defined in the associated tilt actuator to allow pivoting movement of the ribs 10*d* and, thus, the coupler body B relative to the associated tilt actuator.

The rear side R of the one-piece cast coupler body B further comprises left and right arm pin-on locations PL,PR by which the coupler body is operatively connected to associated left and right arms of a loader or other associated machine, respectively, for pivoting movement of the body B relative to the associated machine arms. In the illustrated embodiment, the outermost two ribs 10*a*,10*b* of the left/right coupler portions LP/RP define a channel therebetween that is adapted to receive the associated left/right machine arms. The ribs 10*a*,10*b* include respective aligned apertures A2 and the associated arms are secured to the coupler body B by insertion of pins through the aligned apertures A2 of the pin-on locations PL,PR and through an aligned bore in the associated machine arm.

In the illustrated example, the one-piece cast coupler body B comprises only a single tilt actuator pin-on location PT that is centrally located between the left and right arm pin-on locations PL,PR. In an alternative embodiment, the coupler body B comprises left and right laterally spaced-apart tilt actuator pin-on locations that are part of the left and right coupler portions LP,RP, respectively. In one such alternative embodiment, these left and right tilt actuator pin-on locations are defined between the outer ribs 10*a*,10*b* of the left and right coupler portions LP,RP, with a structure corresponding to the left and right arm pin-on locations PL,PR, aligned with but spaced toward the body upper region U, respectively above the left and right arm pin-on locations PL,PR. With such an alternative structure, the coupler body B is adapted to be operably coupled to associated left and right machine arms at the locations PL,PR and is also adapted to be operably coupled to associated left and right tilt actuators at the left and right tilt actuator pin-on locations, for example for use with a "tool-carrier" or parallel linkage type loader machine.

The coupler body B further comprises a main upper support 40 that extends between and is connected to at least the third and fourth ribs 10*c*,10*d* of both the left and right coupler portions LP,RP and that extends between and interconnects the innermost (fourth) ribs 10*d* of the left and right coupler portions LP,RP, i.e., the main upper support extends from the left third rib 10*c* to the right third rib 10*c* and is connected to both the left and right fourth ribs 10*d*. The main upper support 40 is located adjacent the upper edge U of the body.

The coupler body B includes numerous other support walls/ribs/gussets as shown in the drawings for added strength and rigidity as will be readily understood by one of ordinary skill in the art. These include a face wall 50 that extends between and interconnects at least the left and right third ribs 10*c* and that includes one or more sight openings 55 defined therein to allow an operator to see through the face plate 50 from the rear side R of the coupler body B to the front side F during coupling/decoupling operations.

Figure 12A:
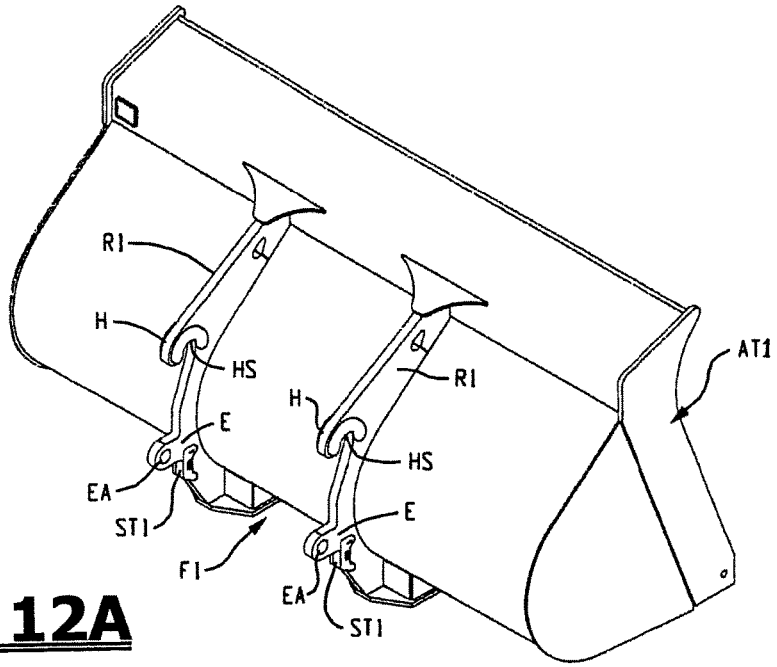
FIG. 12A is a rear isometric view of an attachment including a first type of receiver structure for mating with the coupler of FIGS. 1-8.

For both the left and right coupler portions LP,RP, between the second and third ribs 10*b*,10*c*, the body B comprises first or inner rib pick-up points or inner rib mounts M1. The inner mounts M1 are defined as part of the one-piece cast body B. In particular, the body B comprises cross-bars 44 that are defined as part of the one-piece cast body B and that are polished or otherwise machined after the body is cast to provide a suitable cylindrical attachment rib mounting surface or surface segment (i.e., less than 360 degrees) that is adapted to with engage the hook surface HS of an associated attachment rib R1, e.g., a JRB-style attachment rib, as shown in FIG. 12A.

Figure 12B:
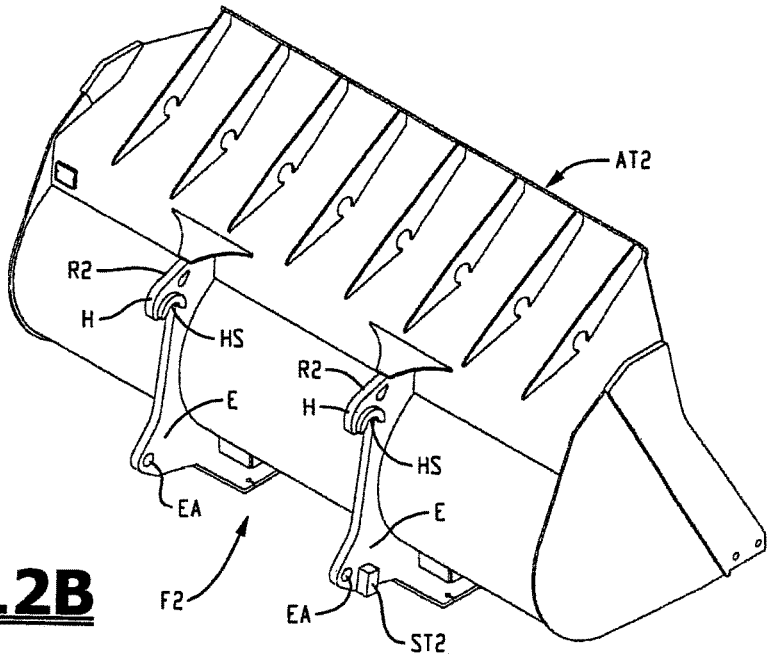
FIG. 12B is a rear isometric view of an attachment including a second type of receiver structure for mating with the coupler of FIGS. 1-8.

The coupler Q further comprises left and right outer rib pick-up points or outer rib mounts M2. The left and right outer rib mounts M2 are respectively provided by left and right removable mount pins 84. The left removable mount pin 84 extends between the left-side first and second ribs 10*a*,10*b* and is releasably connected to the body B for selective installation and removal. The right removable mount pin 84 extends between the right-side first and second ribs 10*a*,10*b* and is releasably connected to the body B for selective installation and removal. Each of the left and right removable mount pins 84 comprises a cylindrical attachment rib mounting outer surface or surface segment (i.e., less than 360 degrees) that is adapted to engage with the hook surface HS of an associated attachment rib R2 such as an ISO 23727 attachment rib structure as described further below in relation to FIG. 12B.

Figure 9:
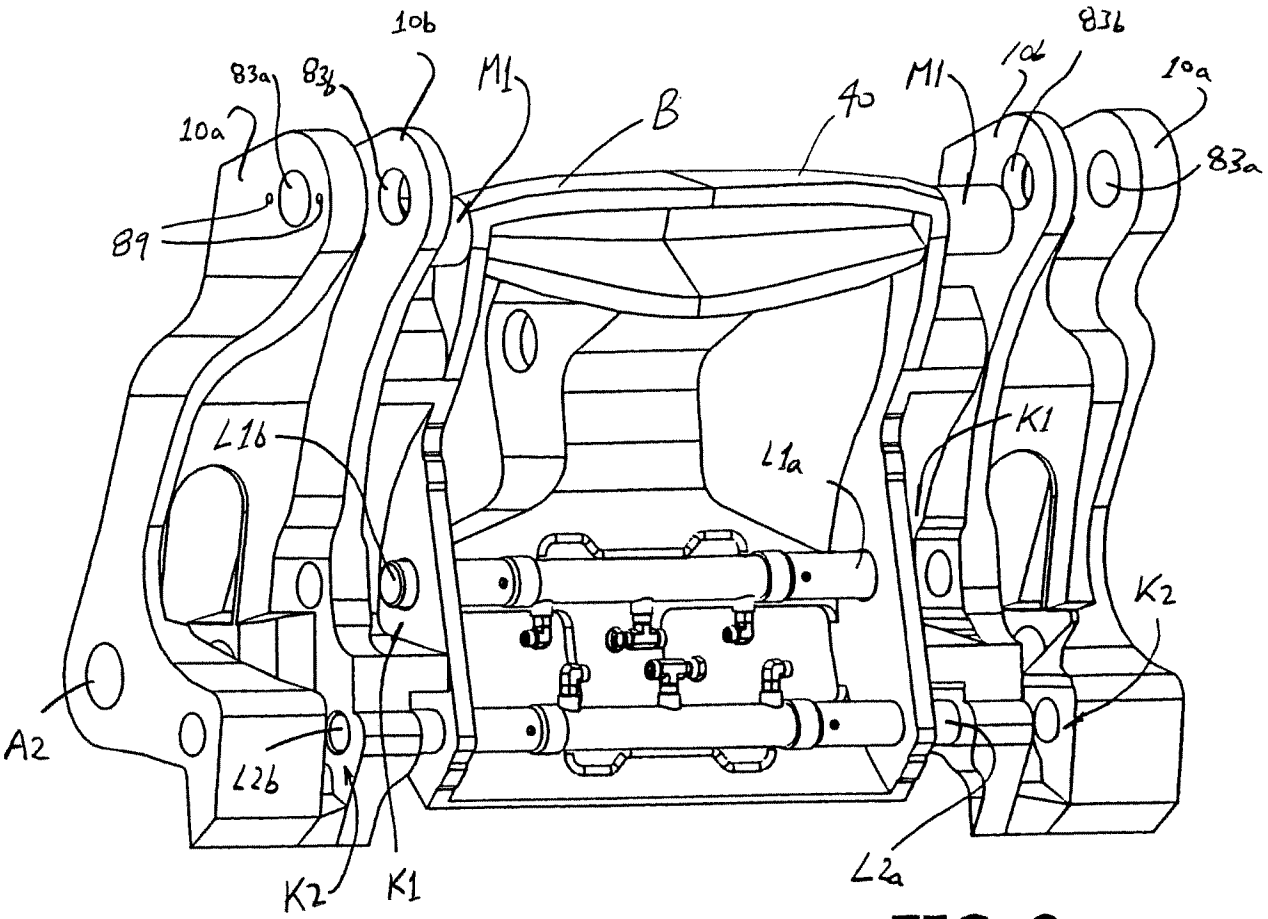
FIGS. 9 and 10 are respective front and rear isometric views that show the coupler with its outer mount pins removed.
Figure 10:
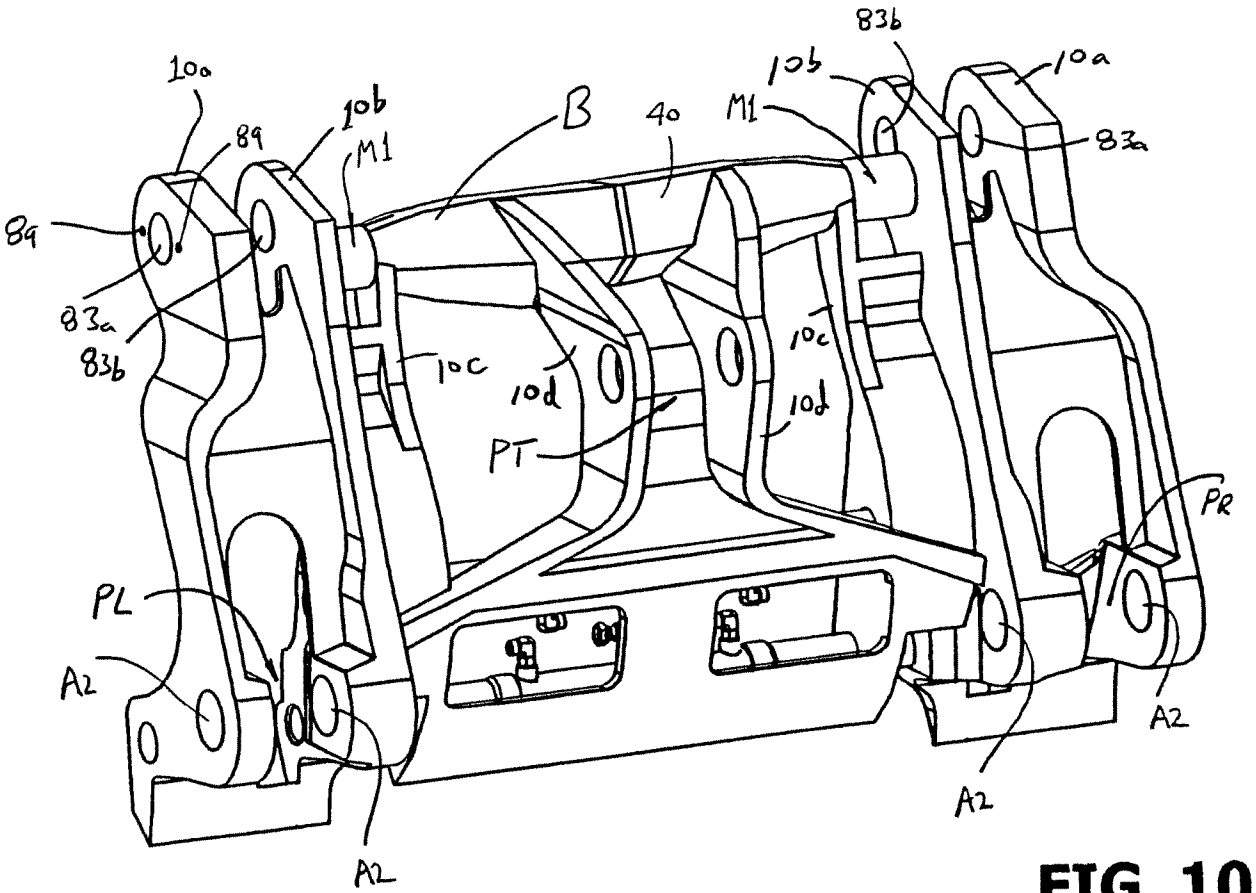
Figure 11:
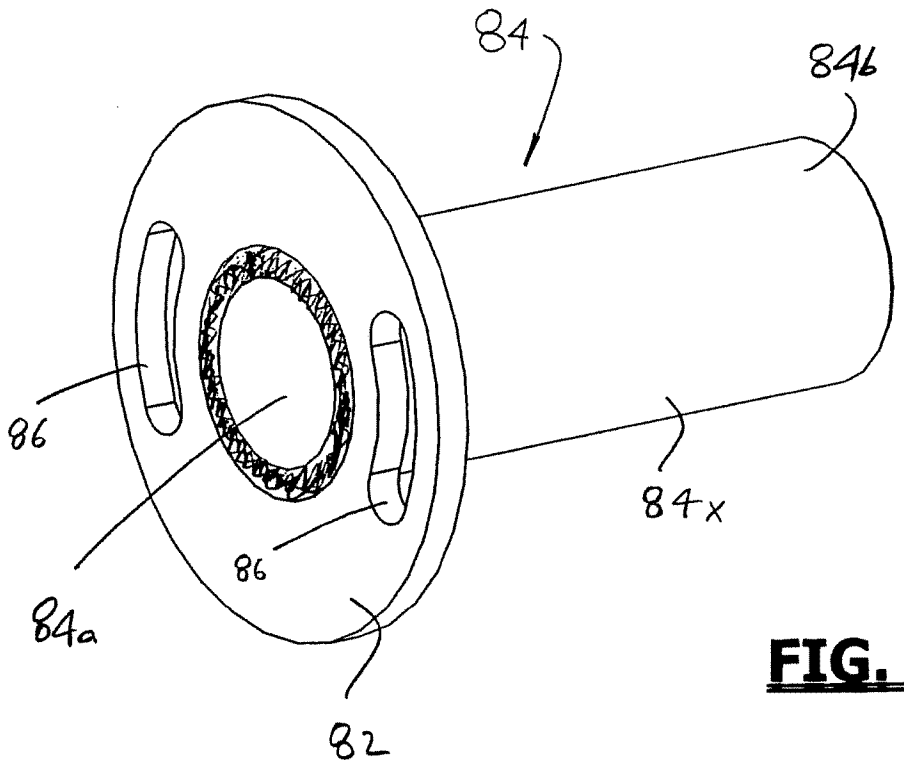
FIG. 11 is an isometric view of a removable outer mount pin provided in accordance with the present development.

FIGS. 9 and 10 show the body B with the left and right removable mount pins 84 removed/uninstalled from the body B. There, it can be seen that the first and second ribs 10*a*,10*b* of the left and right portions LP,RP of the body B include respective first and second mount apertures 83*a*,83*b* that receive the corresponding mount pin 84 when the mount pin 84 is operatively installed. With reference also to FIG. 11, it can be seen that, in the exemplary embodiment, each removable mount pin 84 includes a cylindrical or at least partially cylindrical pin body 84*x* that comprises a first or inner end 84*a* connected by welding or otherwise to a base plate 82 and that comprises a second or outer end 84*b* that projects outwardly away from the base plate 82. The base plate 82 is adapted to be releasably connected to the coupler body B when the mount pin 84 is installed on the coupler Q in its operative position as shown in FIGS. 1-6. In the illustrated embodiment, the base plate 82 comprises at least one and preferably first and second mounting apertures 86 that receive threaded bolts or other fasteners 88 that are threaded into tapped bores 89 (see FIGS. 9 and 10) defined in the left or right first ribs 10*a* of the body B. The apertures 86 are defined as elongated arc segment slots as shown to allow the angular orientation of the base plate 82 relative to the rib 10*a* to vary while still allowing the apertures 86 to register with the respective tapped bores 89, i.e., the use of elongated or kidney-shaped slots/apertures 86 facilitates alignment or registration of the apertures 86 with the tapped bores 89 of the body since the angular position of the base plate 82 relative to the body B is irrelevant when the mounting pin 84 is completely cylindrical as shown herein. Other arrangements are contemplated for connecting the base plates 82 to the body B using other fasteners or other mechanical interconnections.

To install each removable mount pin 84, the pin 84 is slidably inserted first through the first mount aperture 83*a* and across the space between the first and second ribs 10*a*,10*b* and into the second mount aperture 83*b*. The base plate 82 is abutted with an outer face of the first rib 10*a*, and the apertures 86 are registered with the bores 89, and the fasteners 88 are then installed to capture the base plates 82 to the first rib 10*a*. The mounting pins 84 are removed or uninstalled from the body B by reversing the installation sequence. As such, the mounting pins 84 can be removed and replaced as needed due to wear or damage. Alternatively, the outer mounting pins 84 are installed in the opposite direction, with their base plates fixedly secured to the second ribs 10*b*.

As noted above, for the present embodiment, the left and right inner mounts M1 are defined as part of the one-piece cast body B. Alternatively, as described below in relation to an alternative embodiment illustrated in FIGS. 13-17, the left and right inner mounts M1 can comprise respective pins or other structures, such as the removable mounting pins 84 that are releasably connected to the body B in the same manner as described above in relation to the outer mounts M2, or such pins can be permanently installed on the body.

The left and right inner rib mounts M1 are offset relative to the left and right outer rib mounts M2, i.e., offset relative to their position between the coupler body upper and lower regions U,L. As shown, the left and right inner rib mounts M1 are spaced below the left and right outer rib mounts M2 (closer to the coupler body lower region L) as compared at their centers or relative to a reference point on the body such as the central axis of the pin-on apertures A1 or A2.

As described in more detail below, the left and right inner mounts M1 are adapted to mate with first type of attachment coupling or attachment receiver structure F1 (FIG. 12A) comprising left and right ribs R1 connected to a bucket or other attachment AT1. The left and right outer mounts M2 are adapted to mate with a second type of attachment coupling or attachment receiver structure F2 (FIG. 12B) connected to a bucket or other attachment AT2. The second type of attachment receiver structure comprises left and right ribs R2 that are shaped and dimensioned differently as compared to the ribs R1 of the structure F1 and that are spaced-apart a different distance as compared to the spacing of the ribs R1 of the structure F1. For both the receiver structures F1,F2, the ribs R1,R2 each comprise a hook portion H that opens downward and comprises an inner cylindrical surface HS and an eye portion or ear portion E spaced vertically below the hook portion H and comprising a laterally extending lock aperture EA that extends completely through the rib R1,R2. The hook portions H of the left/right ribs R1 of the first type of attachment receiver structure F1 are adapted to mate respectively with the left/right inner rib mounts M1 of the coupler Q so that the left/right cylindrical hook surfaces HS closely abut corresponding cylindrical surfaces of the left/right mounts M1. Similarly, the hook portions H of the left/right ribs R2 of the second type of attachment receiver structure F2 are adapted to mate respectively with the left/right outer rib mounts M2 of the coupler Q so that the left/right cylindrical hook surfaces HS closely abut corresponding cylindrical surfaces of the left/right mounts M2. In one example, the first type of attachment receiver structure F1 is a JRB 416 structure and the second type of attachment receiver structure F2 is provided according to ISO 23727, but these examples are not meant to be limiting in any way. Other examples of attachment receiver structures that can be mated with the coupler Q include John Deere 416, John Deere Hi-Viz, JRB ISO, Volvo ISO, JCB, Komatsu 416, CAT IT.

With continuing reference to FIGS. 1-6, the left and right portions LP,RP of the coupler body B each further comprise an inner locking region such as an inner locking channel K1 defined between the second and third ribs 10*b*,10*c* and spaced toward the coupler lower region L from the inner rib mounts M1, which are also located between the second and third ribs 10*b*,10*c* as described above (note that the rear side of the inner locking channel K1 is closed by a wall K1W that is part of the cast body B). The body B comprises left and right inner stop surfaces 58 defined as a part thereof and located adjacent the left and right inner locking channels K1. The left and right inner stop surfaces 58 are abutted by the stops ST1 of the ribs R1 of the attachment receiver structure F1 when the ribs R1 are fully mated with the coupler Q.

The left and right portions LP,RP of the coupler body B each further comprise outer locking regions such as left and right outer locking channels K2 defined between the first and second ribs 10*a*,10*b* and spaced toward the coupler lower region L from the left and right outer rib mounts M2, respectively, which are also located between the first and second ribs 10*a*,10*b* as described above. The coupler body B includes left and right outer stop surfaces 60 located adjacent the outer locking channels K2. The stop surfaces 60 are abutted by the stops ST2 of the ribs R2 of the attachment receiver structure F2 when the ribs R2 are fully mated with the coupler Q.

When the female ribs R1 of the first type of attachment receiver structure F1 are fully mated with the inner coupler mounts M1, the ear or eye portions E of the left and right female ribs R1 project into the left and right inner locking channels K1 with the stops ST1 of the left and right female ribs R1 abutted with the left and right stop surfaces 58, respectively. Alternatively, in a corresponding fashion, when the female ribs R2 of the second type of attachment receiver structure F2 are fully mated with the outer coupler mounts M2, the ear or eye portions E of the left and right female ribs R2 project between the ribs 10*a*,10*b* into the left and right outer locking channels K2 with the stops ST2 of the left and right female ribs R2 abutted with the left and right stop surfaces 60, respectively.

Figure 7:
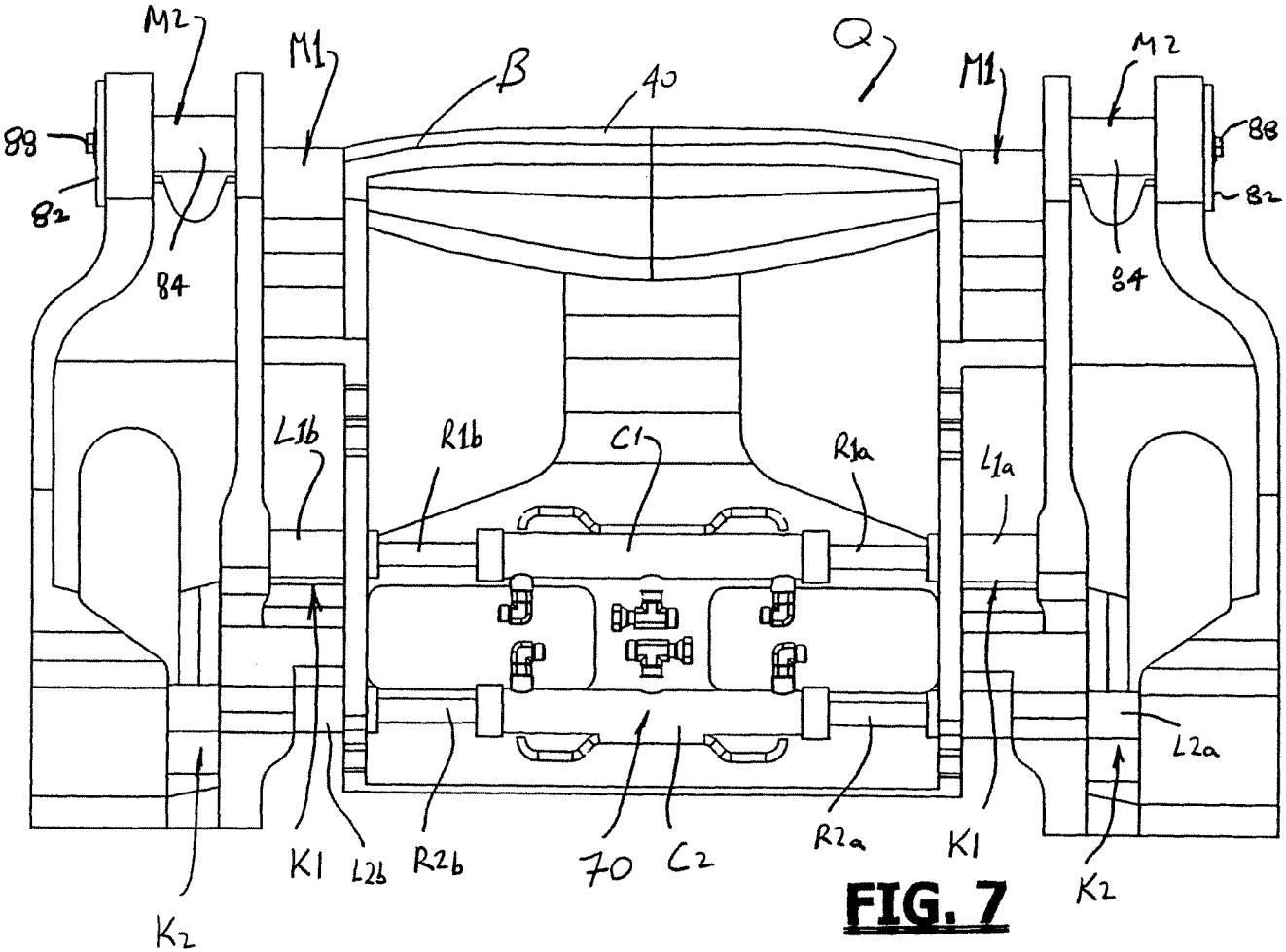
FIG. 7 is a front view that shows the coupler in its locked configuration/condition.
Figure 8:
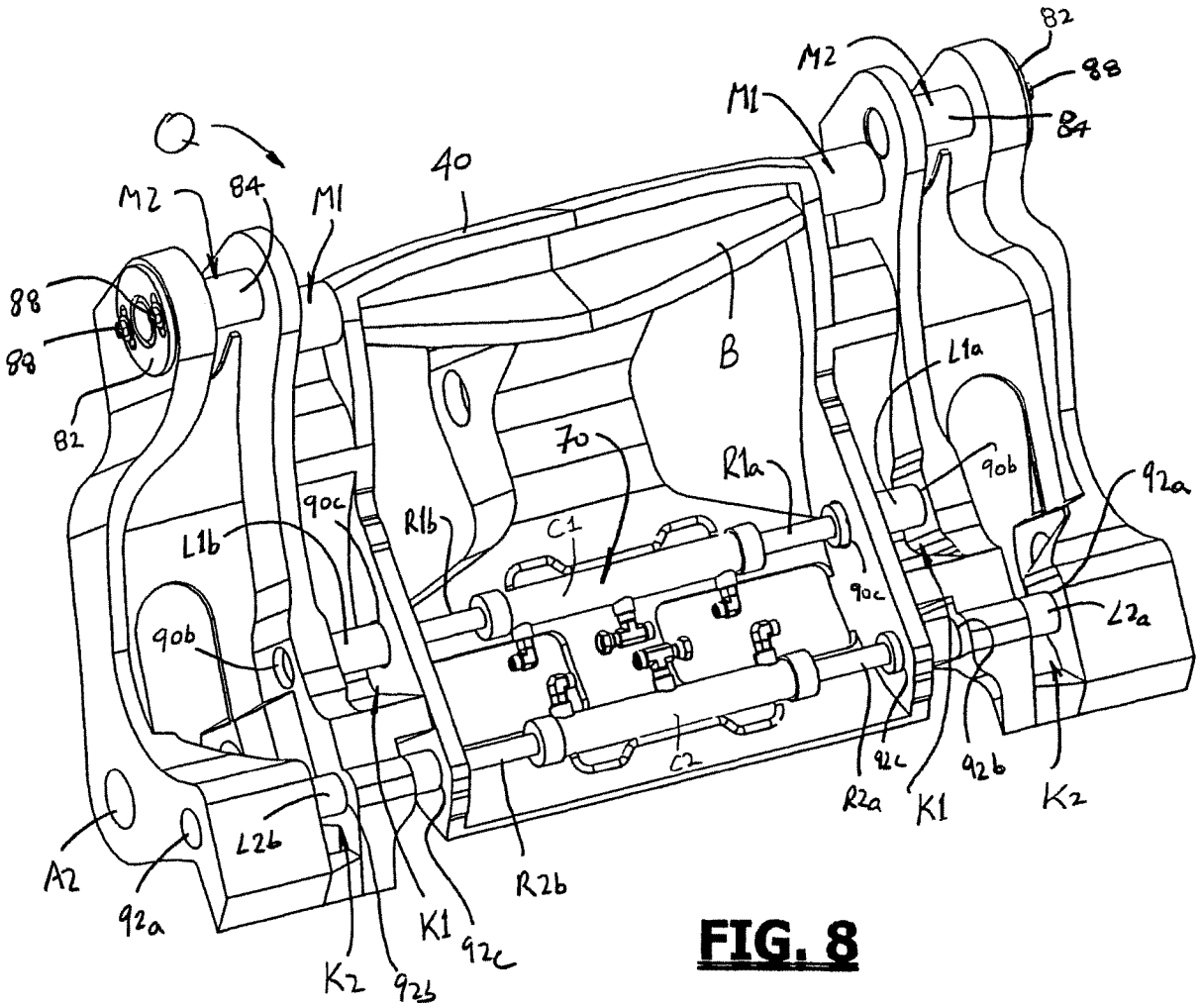
FIG. 8 is a front isometric view that shows the coupler in its locked configuration/condition.

To releasably secure the first type of attachment receiver structure F1 (and the attachment AT1 connected thereto) to the coupler body B, or to releasably secure the second type of attachment receiver structure F2 (and the attachment AT2 connected thereto) to the coupler body B, the quick coupler Q further comprises a lock system 70. In the illustrated embodiment, with reference to FIGS. 2 and 3, the lock system 70 comprises at least one and preferably first and second lock actuators C1,C2, each of which is a hydraulic cylinder or other actuator (as such, the actuators C1,C2 are sometimes referred to herein as cylinders C1,C2). In the illustrated preferred embodiment, the first lock actuator C1 is a double rod-end hydraulic cylinder that comprises left and right rods R1*a*,R1*b* (see FIGS. 3, 7, and 8) that are selectively movable by fluid pressure to and between a retracted position (FIGS. 1-4) and an extended position (FIGS. 7-8), and the second lock actuator C2 is a double rod-end hydraulic cylinder that comprises left and right rods R2*a*,R2*b* (see FIGS. 3, 7, and 8) that are selectively movable by fluid pressure to and between a retracted position (FIGS. 1-4) and an extended position (FIGS. 7-8). The rods R1*a*, R1*b* of the first actuator C1 move between the retracted and extended positions along a first plunger axis PX1 (FIG. 3); the rods R2*a*,R2*b* of the second actuator C2 move between the retracted and extended positions along a second plunger axis PX2 that is parallel to and spaced-apart from the first plunger axis PX1. The rods R1*a*,R1*b* of the first actuator C1 and the rods R2*a*,R2*b* of the second actuator C2 preferably move simultaneously between their retracted and extended positions, for each actuator C1,C2, i.e., the rods R1*a* and R1*b* preferably move in unison with each other and the rods R2*a* and R2*b* preferably move in unison with each other. Also, it is preferred but not required that the actuators C1,C2 are simultaneously actuated in unison such that operation of one actuator C1,C2 is simultaneous with actuation of the other, whether moving all rods from the retracted to extended position or vice versa. Alternatively, the actuators C1, C2 are independently actuated and controlled such that one actuator or the other can be actuated for extension or retraction of its left and right rods while the other actuator is not actuated or otherwise affected. The actuators C1,C2 are mounted adjacent and in front of the face wall 50 and can be covered by a removable protective face plate or shroud (not shown) connected to the body.

The left and right rods R1*a*,R1*b* of the first cylinder C1 are respectively operably connected to left and right first lock plungers L1*a*,L1*b* that extend coaxially along the first plunger axis PX1. The left and right rods R2*a*,R2*b* of the second cylinder C2 are respectively operably connected to left and right second lock plungers L2*a*,L2*b* that extend coaxially along the second plunger axis PX2. The lock plungers L1*a*,L1*b*,L2*a*,L2*b* are each preferably defined by respective cylindrical members. FIGS. 1-4 show the left and right rods R1*a*,R1*b* of the first cylinder C1 retracted so that the respective first lock plungers L1*a*,L1*b* are each in an unlocked position, and also show the left and right rods R2*a*,R2*b* of the second cylinder C2 retracted so that the respective second lock plungers L2*a*,L2*b* are each in an unlocked position. FIGS. 7 and 8 show the rods R1*a*,R1*b* and R2*a*,R2*b* of cylinders C1,C2 extended so that the respective first lock plungers L1*a*,L1*b* and second lock plungers L2*a*,L2*b* are each in a locked position.

In the illustrated embodiment, the spacing between the first plunger axis PX1 and the left and right inner rib mounts M1 is less than the spacing between the second plunger axis PX2 and the left and right outer rib mounts M2 to account for the differences in spacing between the hook portion H and lock aperture EA for the ribs R1 of the first attachment receiver structure F1 as compared to the ribs R2 of the second attachment receiver structure F2. This relationship can be reversed if needed depending upon the particular first and second attachment receiver structures F1,F2 with which the coupler Q is designed to mate, which can vary as noted above in connection with FIGS. 12A and 12B.

In the illustrated embodiment, for both the left and right coupler portions LP,RP, the second and third ribs 10*b*,10*c* include respective plunger apertures 90*b*,90*c* that are coaxial with respect to the first lock plunger axis PX1. Each first lock plunger L1*a*,L1*b* is slidably supported in the aperture 90*c* and is selectively movable by its respective rod R1*a*,R1*b* outward to an extended locked position where it extends into and preferably completely spans the inner lock channel K1 so as to be received also in the aperture 90*b*. When the coupler body B is mated with the first type of attachment receiver structure F1 with the eyes or ears E of the left and right ribs R1 thereof respectively located in the left and right inner lock channels K1, movement of the left and right first lock plungers L1*a*,L1*b* from their retracted unlocked position to their extended locked position will cause the first lock plungers L1*a*,L1*b* to extend through the respective apertures EA of the eyes/ears E to prevent withdrawal of the ears E from the inner lock channels K1. Conversely, the first lock plungers L1*a*,L1*b* are also movable from their extended locked positions to retracted unlocked positions where they are at least partially withdrawn from and do not span the left and right inner lock channels K1. In such retracted unlocked position, the first lock plungers L1*a*,L1*b* do not extend into or through the apertures EA of the eyes/ears E of the first type of attachment coupling structure F1 so that the ears E of the first type of attachment coupling structure F1 are not captured in the left and right inner lock channels K1 and are freely movable into and out of the left and right inner lock channels K1.

For both the left and right coupler portions LP,RP, the first, second, and third ribs 10*a*,10*b*,10*c* include respective plunger apertures 92*a*,92*b*,92*c* that are coaxial with respect to the second lock plunger axis PX2. Each of the second lock plungers L2*a*,L2*b* is slidably supported in the second and third apertures 92*b*,92*c* and is selectively movable by its respective rod R2*a*,R2*b* outward to an extended locked position where the lock plungers L2*a*,L2*b* extends into and preferably completely spans the outer lock channel K2 so as to be received in the aperture 92*a*. When the coupler body B is mated with the second type of attachment receiver structure F2 with the eyes/ears E of the left and right ribs R2 thereof respectively located in the left and right outer lock channels K2, movement of the left and right second lock plungers L2*a*,L2*b* from their retracted unlocked positions to their extended locked positions will cause the second lock plungers L2*a*,L2*b* to extend through the respective apertures EA of the eyes/ears E to prevent withdrawal of the eyes/ears E from the outer lock channels K2. Conversely, the second lock plungers L2*a*,L2*b* are also movable from their extended locked positions to retracted unlocked positions where they are at least partially withdrawn from and do not span the left and right outer lock channels K2. In such retracted unlocked position, the second lock plungers L2*a*,L2*b* do not extend into or through the apertures EA of the eyes/ears E of the second type of attachment coupling structure F2 so that the eyes/ears E of the second type of attachment coupling structure F2 are not captured in the left and right outer lock channels K2 and are freely movable into and out of the left and right outer lock channels K2.

In an alternative embodiment, the lock system 70 uses only a single hydraulic cylinder that is operably coupled to both the left and right first lock plungers L1*a*,L1*b* and to both the left and right second lock plungers L2*a*,L2*b* and that selectively moves all of same between their respective extended (locked) and retracted (unlocked) positions. An example of such a lock system is disclosed in U.S. Pat. No. 7,836,616, the entire disclosure of which is expressly incorporated by reference into the present specification. In another alternative embodiment, the lock system 70 uses a single left hydraulic cylinder or other actuator that is operably coupled to both the left first lock plunger L1*a* and the left second lock plunger L2*a*, and a separate right hydraulic cylinder or other actuator that is operably coupled to both the right first lock plunger L1*b* and the right second lock plunger L2*b*, wherein the left actuator moves the first and second left lock plungers L1*a*,L2*a* between their respective extended (locked) and retracted (unlocked) positions, and wherein the right actuator moves the first and second right lock plungers L1*b*,L2*b* between their respective extended (locked) and retracted (unlocked) positions. Also, a separate cylinder or other actuator can be used to extend and retract each of the individual lock plungers L1*a*,L1*b*,L2*a*,L2*b*. Other lock systems for moving the left and right first lock plungers L1*a*,L1*b* and the left and right second lock plungers L2*a*, L2*b* between their extended (locked) and retracted (unlocked) positions can be used.

When the coupler Q is fully mated with the first type of attachment receiver structure F1 as described above, the eye/ear apertures EA of the left and right female ribs R1 are respectively located in the left and right inner locking channels K1 and are at least approximately centered on the first plunger axis PX1 so that the eye/ear apertures EA are aligned with the first lock plungers L1*a*,L1*b*, and movement of the left and right first lock plungers L1*a*,L1*b* from their retracted (unlocked) positions to their extended (locked) positions will cause the first lock plungers L1*a*,L1*b* to extend through the aligned eye/ear apertures EA to capture the ribs R1 to the coupler body B for use of the bucket or other attachment to which the ribs R1 are connected. Likewise, when the coupler Q is fully mated with the second type of attachment receiver structure F2 as described above, the eye/ear apertures EA of the left and right female ribs R2 are respectively located in the left and right outer locking channels K2 and are at least approximately centered on the second plunger axis PX2 so that the eye/ear apertures EA are aligned with the second lock plungers L2*a*,L2*b*, and movement of the left and right second plungers L2*a*,L2*b* from their retracted positions to their extended positions will cause the second lock plungers L2*a*,L2*b* to extend through the aligned eye/ear apertures EA to capture the ribs R2 to the coupler body B for use of the bucket or other attachment to which the ribs R2 are connected. When the first lock plungers L1*a*,L1*b* and second lock plungers L2*a*,L2*b* are in their retracted (unlocked) positions, the coupler body B is able to be freely mated with or separated from either the first type of attachment receiver structure F1 or the second type of attachment receiver structure F2, because the first lock plungers L1*a*,L1*b* and second lock plungers L2*a*,L2*b* do not obstruct the inner and outer locking channels K1,K2 for either the left or right coupler portion LP,RP.

Figure 13:
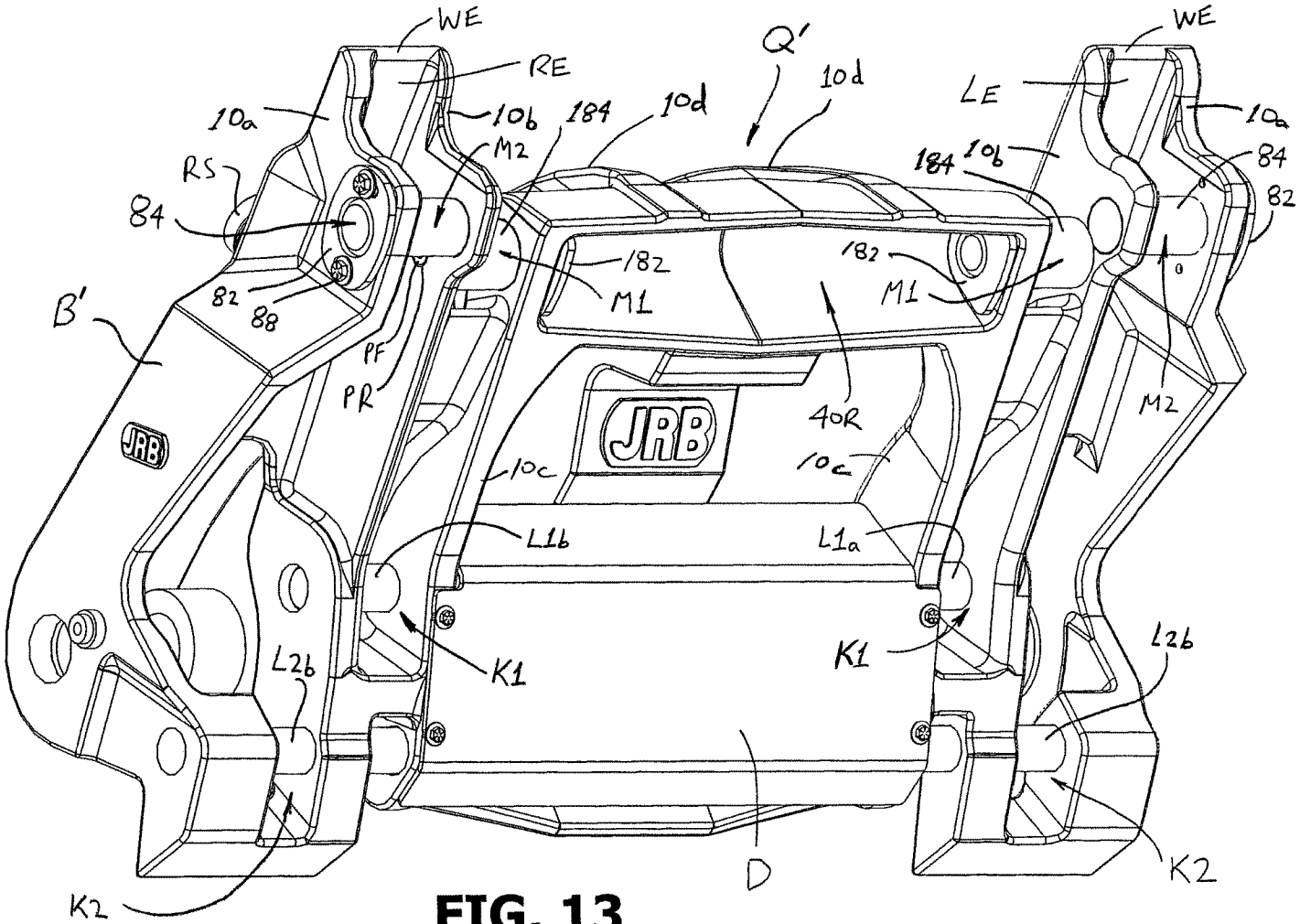
FIGS. 13 and 14 are respective front and rear isometric views of an alternative attachment coupler formed in accordance with the present development, in which both the inner and outer mount pins are removable.
Figure 14:
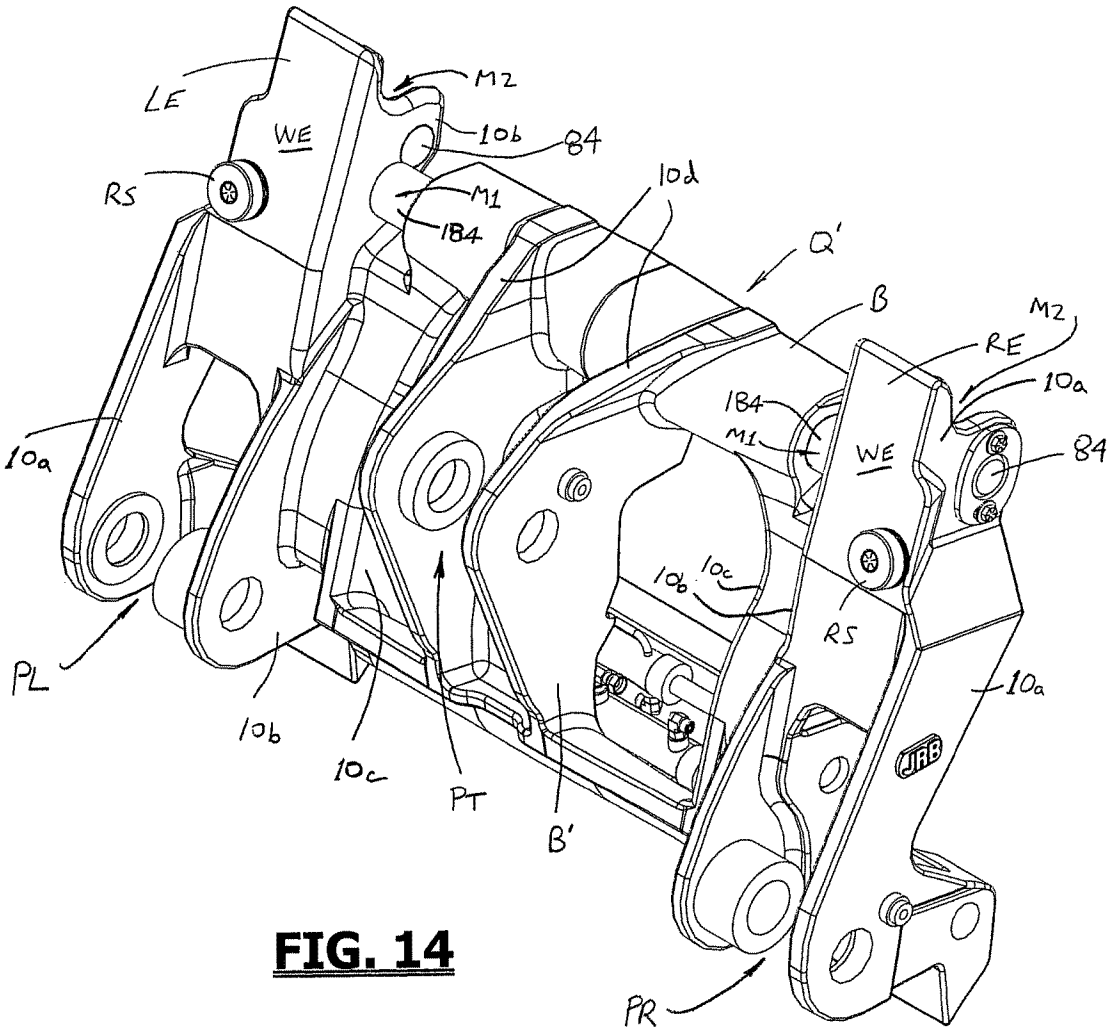

FIGS. 13 and 14 show an alternative attachment coupler Q' that is identical to the attachment coupler Q described above, except as otherwise shown and/or described herein. Like components of the alternative coupler Q' relative to the coupler Q are identified with like reference numbers/letters. In particular, as referenced briefly above, the coupler Q' differs from the coupler Q primarily in the fact that both its left and right outer rib mounts M2 and its left and right inner rib mounts M1 are provided by removable mount pins 84 (for the outer rib mounts M2) and 184 (for the inner rib mounts M1). The alternative coupler Q' includes a body B' which is cast in one-piece from steel or another metal as described above in relation to the body B, but which varies slight from the body B as shown and as described below.

Referring first to the alternative body B', unlike the body B described above, it additionally comprises left and right roll-back stop ears LE,RE located respectively on the left and right sides of the coupler body B'. In the illustrated embodiment, each roll-back ear LE,RE is defined by a wall WE that extends between and interconnects the first and second ribs 10*a*,10*b*. A rear face of the wall WE is oriented away from the front side F of the body B' and provides a mounting surface to which a roll-back stop RS is connected. The wall WE is conformed and dimensioned so that the position of the roll-back stop RS can be varied depending upon the associated loader to which the coupler Q' will be operably connected. In one embodiment, the roll-back stop RS is an adjustable stop as disclosed in U.S. Pat. No. 7,337,564, the entire disclosure of which is hereby expressly incorporated by reference into the present specification.

Figure 15:
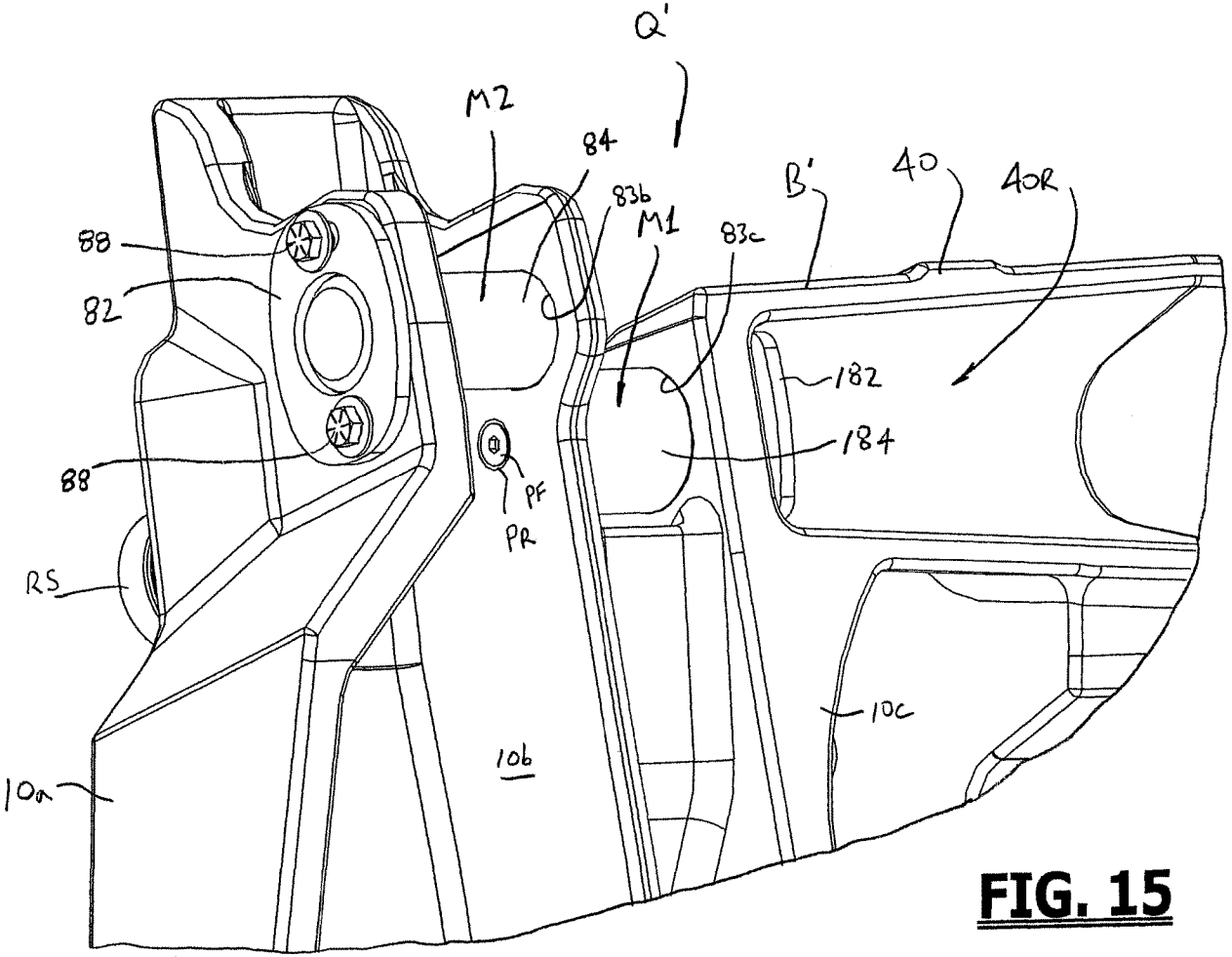
FIG. 15 is an enlarged portion of FIG. 13.
Figure 16:
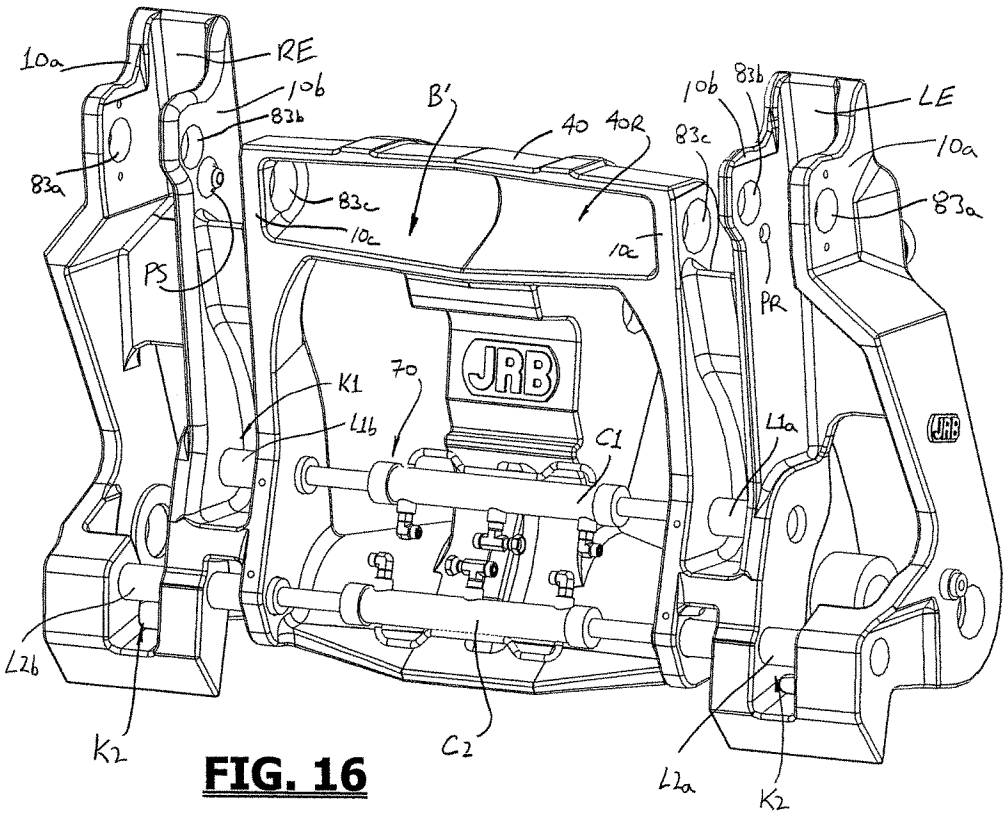
FIG. 16 is another front isometric view of the coupler of FIGS. 13 and 14, but showing the coupler with its front cover shroud removed and the inner and outer mount pins removed.

As noted, both the inner and outer rib mounts M1,M2 on both the left portion LP and right portion RP of the body B' comprise removable mount pins. FIG. 16 shows the coupler Q' with both its inner and outer rib mounts M1,M2 removed. As described above in relation to the coupler Q, the first and second ribs 10*a*,10*b* of both the left and right portions LP,RP of the body include respective first and second mount apertures 83*a*,83*b* that receive the corresponding removable outer mount pin 84 that provides the outer rib mount M2 when the outer mount pin 84 is operatively installed. The third ribs 10*c* of both the left and right portions LP,RP of the body include respective third mount apertures 83*c* that receive the corresponding removable inner mount pin 184 that provides the inner rib mount M1 when the inner mount pin 184 is operatively installed. The second rib 10*b* of the body B' also includes a pin retainer aperture PR (FIGS. 15,16) that is preferably countersunk on its outer side (facing the first rib 10*a*) and that is adapted to receive a bolt or other pin retaining fastener PF used to secure the removable inner mount pins 184 to the body B'. The opposite inner face of the second rib 10*b* includes a pin mounting or locating boss or stud PS (FIG. 16) that projects therefrom toward the third rib 10*c*. The pin mounting/locating stud PS is preferably cast as part of the one-piece body B' but can alternatively be provided as a separate piece that is affixed to the body.

Figure 17:
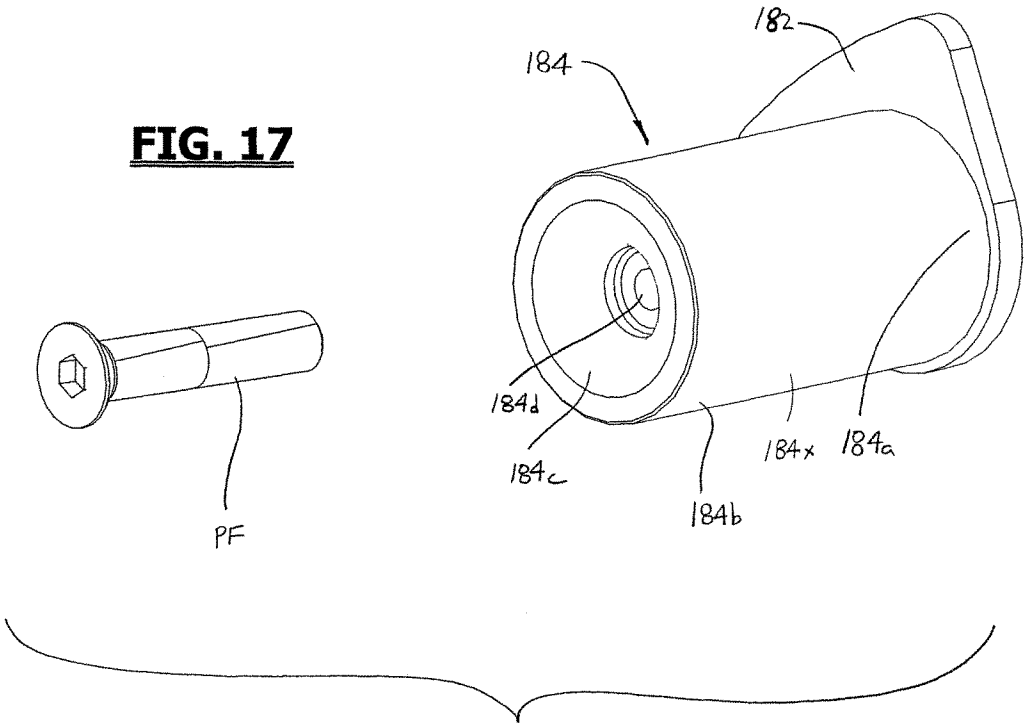
FIG. 17 is an isometric view of a removable inner mount pin provided in accordance with the present development, and also shows a retaining fastener that is selectively engaged with the removable inner mount pin.

Although the removable outer mount pins 184 could be structured similarly to the removable outer mount pins 84, they are provided with an alternative structure in the illustrated embodiment as described with reference to FIG. 17. There, it can be seen that each removable inner mount pin 184 includes a cylindrical or at least partially cylindrical pin body 184*x* that comprises a first or inner end 184*a* connected by welding or otherwise to a non-circular base plate 182 and a second or outer end 184*b* spaced from the base plate 182. The base plate 182 is shaped and sized so that it is non-rotatably received within a recess 40R defined in the main upper support 40 of the body B' such that the base plate 182 is in abutment with the inner face of the third rib 10*c* which closes an end of the recess 40R as best seen in FIGS. 13 and 15, i.e., the recess 40R includes or is partly defined by left and right end walls provided respectively by portions of the third ribs 10*c* of the left and right portions of the body B'. When the base plate 182 is so positioned, the cylindrical pin 184 extends between the second and third ribs 10*b*,10*c* with its inner end 184*a* located in the third mount aperture 83C and with its outer end 184*b* located in abutment with the second rib 10*b*. As shown in FIG. 17, the outer end 184*b* of each removable inner mount pin 184 includes a locator recess 184*c* that closely receives the mounting stud PS (FIG. 16) when the removable inner mount pin 184 is operably connected to the body B'. Each removable inner mount pin 184 is operably secured to the body B' using the pin retaining fastener PF, by inserting the pin retaining fastener PF into the pin retainer aperture PR and then threadably engaging the pin retaining fastener PF in a tapped bore 184*d* that is located within the locator recess 184C of the pin 184. When the pin retaining fastener PF is advanced into the tapped bore 184*d*, it draws the removable inner mount pin body 184*x* toward and into abutment with the second rib 10*b* and draws the base plate 182 toward and into abutment with the third rib 10*c* inside the recess 40R. Alternatively, the orientation of each inner mount pin 184 relative to the coupler body B' is reversed, such that the base plate 182 is located in abutment with the second rib 10*b* and the pin retainer aperture located in the third rib 10*c*. As noted, the base plate 182 is non-rotatably engaged with the body B' so that the inner mount pins 184 will not rotate relative to the body during rotation of the pin retaining fastener PF when installing or removing the inner mount pins 184.

Other structures and methods are contemplated for securing the removable outer mount pins 84 and/or the removable inner mount pins 184 to the coupler body B,B'. For example, the removable mount pins 84,184 can be threaded directly to the coupler body B,B' or otherwise removably engaged with the coupler body B,B', or can be removably friction/press fit to the coupler body B,B'. The term "removable" or "removably" is intended to encompass any arrangement in which the mount pins 84/184 can be disconnected from the coupler body B,B' without breaking a weld and/or without machining, cutting, torching, or otherwise removing material from the mount pins 84/184 and/or the coupler body B,B'.

In an alternative embodiment, the outer rib mounts M2 are defined as part of the one-piece cast body B' or are permanently affixed thereto by welding, while the inner rib mounts M1 are provided by the removable mount pins 184. A coupler Q,Q' provided in accordance with the present development includes the removable inner rib mounts M1, the removable outer rib mounts M2, or both.

The coupler Q' comprises an optional face plate or shroud D connected thereto on the front side F of the body B' using bolts or other fasteners or by other means. The shroud D covers and protects the first and second hydraulic cylinders or other actuators C1,C2 and associated components of the lock system 70. The shroud D extends between at least the third rib 10*c* on the left portion LP of the body and the third rib 10*c* on the right portion RP of the body and, as shown, is connected to the left and right third ribs 10*c*.

In an alternative embodiment, the coupler body B,B' is not cast in one-piece, but is instead fabricated from multiple different plates, castings, ribs, bars, and other pieces or steel or other metal that are welded, bolted and/or otherwise fixedly secured together to define a fabricated coupler frame or coupler body B,B'. In such embodiment, the removable outer mount pins 84 and/or the removable inner mount pins 184 are included as described above. If removable mount pins 84,184 are used for only the inner rib mounts M1 or for only the outer rib mounts M2, the other set of rib mounts M1,M2 are provided by a bar or other structure that is welded or otherwise fixedly secured to the fabricated coupler body B,B'.

The claims, as originally presented and as they may be amended, encompass variations, alternatives, modifications, improvements, equivalents, and substantial equivalents of the embodiments and teachings disclosed herein.

The invention claimed is:

1. A loader coupler adapted to mate alternatively with both first and second associated attachment receiver structures, said loader coupler comprising:

a one-piece cast steel body comprising left and right portions and upper and lower regions;

left and right laterally spaced-apart outer rib mounts comprising respective outer mount pins connected to said body, said left and right outer rib mounts adapted to releasably mate respectively with left and right open hook portions of the second associated attachment receiver structure;

left and right outer locking regions defined by said one-piece body and aligned respectively with the left and right outer rib mounts, said left and right outer locking regions adapted to receive left and right ear portions of the second associated attachment receiver structure, wherein:

(i) said left outer locking region is defined between first and second ribs of said left portion of said body, and said left outer rib mount extends between said first and second ribs of said left portion of said body, said left outer locking region spaced from said left outer rib mount toward said lower region of said body; and, (ii) said right outer locking region is defined between first and second ribs of said right portion of said body, and said right outer rib mount extends between said first and second ribs of said right portion of said body, said right outer locking region spaced from said right outer rib mount toward said lower region of said body;

left and right laterally spaced-apart inner rib mounts connected to said body, said left and right inner rib mounts adapted to releasably mate respectively with left and right open hook portions of the first associated attachment receiver structure, wherein each of said left and right inner rib mounts comprise respective left and right inner mount pins each comprising: a pin body including a first end and a second end; and, a base plate connected to said first end;

said pin body of said left inner mount pin extending between said second and third ribs of said left portion of said body, and said base plate of said left inner mount pin abutted with said third rib of said left portion of said body;

said pin body of said right inner mount pin extending between said second and third ribs of said right portion of said body, and said base plate of said right inner mount pin abutted with said third rib of said right portion of said body;

left and right inner locking regions defined by said one-piece body and aligned respectively with the left and right inner rib mounts, said left and right inner locking regions adapted to receive left and right ear portions of the first associated attachment receiver structure, wherein:

(i) said left inner locking region is defined between said second rib and a third rib of said left portion of said body, and said left inner rib mount extends between said second and third ribs of said left portion of said body, said left inner locking region spaced from said left inner rib mount toward said lower region of said body; and, (ii) said right inner locking region is defined between said second rib and a third rib of said right portion of said body, and said right inner rib mount extends between said second and third ribs of said right portion of said body, said right inner locking region spaced from said right inner rib mount toward said lower region of said body;

a lock system connected to said one-piece body, said lock system comprising: (i) left and right first lock plungers that move between locked and unlocked positions relative to said left and right inner locking regions, respectively; and, (ii) left and right second lock plungers that move between locked and unlocked positions relative to said left and right outer locking regions, respectively, wherein:

said left and right first lock plungers extend into and completely between the respective second and third ribs of said left and right inner locking regions when located in their locked positions and said left and right first lock plungers are at least partially withdrawn from said left and right inner locking regions when located in their unlocked positions;

said left and right second lock plungers extend into and completely between the respective first and second ribs of said left and right outer locking regions when located in their locked positions and are at least partially withdrawn from said left and right outer locking regions when located in their unlocked positions;

the respective mount pins of said left and right outer rib mounts removably connected to said one-piece cast steel body, each of said left and right outer mount pins comprising a pin body including a first end, a second end, and a base plate connected to said first end, wherein:

said pin body of said left outer mount pin extends between the first and second ribs of said left portion of said body, and said base plate of said left outer mount pin is fixedly secured to one of said first and second ribs of said left portion of said body by at least one removable fastener; and, said pin body of said right outer mount pin extends between the first and second ribs of said right portion of said body, and said base plate of said right outer mount pin is fixedly secured to one of said first and second ribs of said right portion of said body by at least one removable fastener;

said one-piece body further comprising a rear side including a left arm pin-on location adapted for pivoting connection of a left associated loader arm, a right arm pin-on location adapted for pivoting connection of a right associated loader arm, and a tilt actuator pin-on location located between the left and right arm pin-on locations and adapted for pivoting connection to an associated tilt actuators;

wherein:

said second rib on both said left and right portions of said coupler body includes a pin retaining aperture extending there through, and said second rib on both said left and right portions of said coupler body includes a pin locating stud that projects from said second rib toward said third rib;

said second end of said left inner mount pin includes a recess that receives said pin locating stud on said left portion of said coupler body;

said second end of said right inner mount pin includes a recess that receives said pin locating stud on said right portion of said coupler body;

said coupler further comprising: (i) a left pin retaining fastener that extends through said pin retaining aperture on said left portion of said coupler body and that is threadably engaged with said left inner mount pin; and, (ii) a right pin retaining fastener that extends through said pin retaining aperture on said right portion of said coupler body and that is threadably engaged with said right inner mount pin;

said pin retaining aperture on said left portion of said coupler body and said left pin retaining fastener extends through said pin locating stud on said left portion of said coupler body; and, said pin retaining aperture on said right portion of said coupler body and said right pin retaining fastener extends through said pin locating stud on said right portion of said coupler body.

2. The loader coupler as set forth in claim 1, wherein, for each of said left and right outer mount pins, said at least one removable fastener used to secure said base plate to said body comprises first and second removable fasteners, and wherein said base plate of each of said left and right outer mount pins includes first and second elongated arcuate apertures through which said first and second fasteners are inserted for engagement with said coupler body.

3. The loader coupler as set forth in claim 1, wherein said base plate of each of said left and right inner mount pins is non-rotatably engaged with said coupler body.

4. The loader coupler as set forth in claim 3, wherein said coupler body comprises a main upper support that includes a recess with opposite left and right end walls defined respectively by portions of said third ribs of said left and right portions of said coupler body, and wherein said base plate of said left inner mount pin is located in said recess and abutted with said left end wall and said base plate of said right inner mount pin is located in said recess and abutted with said right end wall.

* * * * *